US007882598B2

(12) United States Patent
Coles et al.

(10) Patent No.: US 7,882,598 B2
(45) Date of Patent: Feb. 8, 2011

(54) FASTENING BAND

(75) Inventors: David Coles, Bath (GB); Daniel Ward, Chilcompton (GB)

(73) Assignee: HCL Fasteners Ltd (GB)

( * ) Notice: Subject to any disclaimer, the term of this patent is extended or adjusted under 35 U.S.C. 154(b) by 886 days.

(21) Appl. No.: 11/576,980

(22) PCT Filed: Oct. 10, 2005

(86) PCT No.: PCT/GB2005/003875

§ 371 (c)(1),
(2), (4) Date: Jul. 5, 2007

(87) PCT Pub. No.: WO2006/040524

PCT Pub. Date: Apr. 20, 2006

(65) Prior Publication Data

US 2008/0083095 A1 Apr. 10, 2008

(30) Foreign Application Priority Data

Oct. 11, 2004 (GB) ..... 0422548.8

(51) Int. Cl.
*B65D 63/00* (2006.01)

(52) U.S. Cl. ..... 24/16 PB

(58) Field of Classification Search ..... 24/16 PB; D8/394

See application file for complete search history.

(56) References Cited

U.S. PATENT DOCUMENTS

| | | | | |
|---|---|---|---|---|
| 4,008,512 | A | 2/1977 | Prodel | |
| 4,377,887 | A | 3/1983 | Valestin | |
| 4,862,561 | A | 9/1989 | Lichtenberg | |
| 4,882,813 | A | 11/1989 | Nakamura | |
| 5,644,819 | A * | 7/1997 | Lyons | 24/16 PB |
| 5,890,265 | A * | 4/1999 | Christian et al. | 24/16 PB |
| 6,701,579 | B1 * | 3/2004 | De La Pena Razquin | 24/16 PB |
| 2003/0066169 | A1 * | 4/2003 | Liu | 24/16 PB |

FOREIGN PATENT DOCUMENTS

| | | |
|---|---|---|
| GB | 1519868 | 8/1978 |
| GB | 1600601 | 10/1981 |
| GB | 2224469 A | 5/1990 |
| GB | 2308153 A | 6/1997 |
| WO | 0000407 A1 | 1/2000 |

* cited by examiner

*Primary Examiner*—Robert J Sandy
(74) *Attorney, Agent, or Firm*—Brooks Kushman P.C.

(57) ABSTRACT

A compact low-profile clamp for clamping objects comprises a toothed band formed into a closed loop having a first end and a second end and a head that holds the band in a closed loop and comprises a first and a second side-by-side passageways that also include teeth. The second end of the band is secured in a second passageway. The band is then passed around the object to form a loop and the first end of the band is pushed into the first passageway; the teeth hold the band in the closed loop. A chamber located at one end of the first passageway has an opening that is accessible from the outside to enable the first end of the band to be pulled to tighten the band.

16 Claims, 4 Drawing Sheets

FASTENING BAND

TECHNICAL FIELD

The present invention relates to fastening bands of the type comprising a band and a head for securing the band in a closed loop around an object. At least one of the ends of the band is secured in the head by means of teeth provided on the band and in the head; the two sets of teeth inter-engage to hold the band, as mentioned.

The present invention is especially concerned with a fastening band that compresses or clamps the article or articles encircled by the band, that is to say the band is under tension in use.

BACKGROUND ART

Fasteners having a head and a band that can be formed into a closed loop, with at least one end of the band being held by teeth within the head are well known, for example UK patent no. 1,600,601. In this arrangement, the head includes a pair of jaws, each having inwardly-facing teeth, which engage with teeth on the top and bottom surfaces of the band. The head has a substantial thickness that can snag other objects. For example, in underwater applications, the head could snag on fishing nets, diver's wetsuits/breathing apparatus. Also, when the band is secured around an object that is moved, for example a pipe, it stands proud of the pipe and can catch on other objects and/or damage other objects that come into contact with the pipe.

WO00/00407 describes a fastener having a toothed band having two ends. One end of the band is secured by a pair of toothed jaws in the head, which engage with the teeth on the band. The head also includes a passageway provided with a second pair of jaws; the second end of the band, after it has been formed into a closed loop, is fed into the passageway and through the pair of jaws. The teeth on the jaws engage with the teeth on the second end of the band to hold it in a closed-loop configuration. In order to tighten the band around an object, the portion of the second end that has passed through the second pair of jaws can be grasped to increase the tension in the band. Like the arrangement described in GB 1600601, the head is relatively tall and can snag on other objects. In addition, the free, second end band can also catch on nets and other objects.

Simple cable ties include a pair of jaws, at least one of which includes teeth and engage with teeth on the band of the cable tie. The back of the pair of jaws is open so that the free end of the cable tie can be pulled through to tighten the tie. It is also known to cut off the excess part of the cable tie that has passed through the pair of jaws but this generally leads to a sharp, ragged edge that can damage other objects if pressed against them.

GB-A-2224469 describes a file binder for securing papers within a file and has a base secured to the file, two flexible elements that are connected at one end to the base and that can each pass through holes punched in the paper. Two passageways are provided in the base that each contain a toothed pawl. Each pawl engages teeth on the second end of one of the flexible members. In this way, the flexible members are each maintained in a closed loop that holds the stack of papers.

GB-A-2308153 discloses a cable fastener having a head and a separate flexible toothed band. The band is formed into a closed loop and the ends of the band are secured in the head. When secured in the head, the band ends lie one above the other and so the head must be relatively tall.

GB-A-2308153 discloses a cable tie having a flexible toothed band and a head secured at one end of the band. The head has a passageway through it; the free end of the band is fed in through one end of the passageway and out through the other end. The passageway has a set of one or more of teeth in the passageway that engage corresponding teeth on the band and so prevent the band being pulled back through the passageway. The band can be tightened by grasping the free end of the band that has been pushed through the head, and so is protruding, and pulling on the free end. The set of teeth can be accessed through an opening in the top of the head to release the teeth from the band and hence allow the free end of the band to be pulled back through the passageway, thereby releasing the tie.

DISCLOSURE OF INVENTION

According to a first aspect of the present invention, there is provided a method of securing a fastener around at least one object, the fastener comprising:

- a band having a first and a second end and teeth provided on at least the first end; and
- a head for holding the band in a closed loop, the head having (a) an inner face directed towards the inside of the loop, when formed, and (b) an outer face opposed to the inner face;

wherein the method comprises:

- engaging the second end of the band with the head, if it is not already so engaged;
- forming the band into a loop;
- passing the first end of the band into a passageway that is formed in the head and that includes at least one tooth and engaging the said at least one tooth with the teeth on the first end of the band,
- passing the first end of the band into a chamber in the head located at one end of the passageway, wherein the chamber has an opening that is formed in the outer face of the head,
- engaging, through the opening in the outer face of the head, a leading part of the first end of the band and pulling the first end of the band through the passageway to tighten the band on the at least one object.

The leading end of the first end of the band should be accommodated in the chamber; if, when the band is tightened, the band end is too long, the band should be severed such that the new leading end is accommodated in the chamber.

The passageway may terminate in the chamber. Alternatively, a second passageway may be provided on the opposed side of the chamber that is a continuation of the passageway; the second passageway may then be configured to receive the second end of the band, in which case at least one tooth may be arranged to engage teeth on the second end of the band and prevent it from being pulled out of the second passageway.

According to a second aspect of the present invention there is provided a fastener comprising:

- a band having a first and a second end and teeth provided on at least the first end and
- a head for holding the band in a closed loop, the head having an inner face configured to be directed towards the inside of the loop, when formed, and an outer face opposed to the inner face, wherein the head comprises:
- a passageway for receiving the first end of the band, the passageway including at least one tooth that is arranged to engage the teeth on the first end of the band and prevent the band from being pulled out of the passageway; and a chamber located at one end of the passageway and having an opening in the outer face of the head, the chamber being accessible, through the opening, from outside the head to enable a leading part of the first end of the band that has passed through the passageway to be engaged and pulled through the passageway, and wherein said chamber is configured to accommodate the leading part of the first end;

wherein the passageway either terminates in the chamber or a second passageway is provided that is a continuation of the passageway, which second passageway is configured to receive the second end of the band and includes at least one tooth that is arranged to engage the teeth on the second end of the band and prevent the band from being pulled out of the second passageway.

The present invention also provides the head alone, i.e. independently of the band, since the band may be supplied separately as a reel and appropriate lengths cut off for use.

The chamber may include an openable and closeable cover for the opening in the outer face of the head; the cover can be used to close the chamber, thereby preventing access to the chamber from outside the head; the cover can allow the opening to be opened, thereby allowing access to the chamber.

The second end of the band may be permanently secured to the head. Alternatively it can be secured using a second passageway, as discussed above.

The second end of the band need not be accommodated in a chamber but it can be if desired; it could be the same chamber as already described or a separate chamber. However, the second end may be simply accommodated in the second passageway.

In order that the fastener has a low profile, to prevent it snagging, the head is configured such that the first and second ends of the band are secured side-by-side with each other and with the chamber, i.e. the band ends and the chamber are all arranged in line in the head. Thus when the second band end is secured in a second passageway, the passageway, the chamber and the second passageway are preferably arranged side-by-side in the head.

The ends of the band are held within the head and so cannot be snagged.

Teeth are preferably provided only on one face of the band, preferably the face that is directed outwardly when the band is formed into a closed loop.

The present invention also provides a fastener comprising:

a band formed into a closed loop, said band having a first end and a second end and teeth on at least the first end and a head holding the band in a closed loop, the head having an inner face directed towards the inside of the loop and an outer face opposed to the inner face, wherein the second end of the band is affixed to the head and the head comprises:

a passageway in which the first end of the band is received, the passageway including at least one tooth that engages the teeth on the first end of the band and prevents the band from being pulled out of the passageway;

a chamber located at one end of the passageway and having an opening in the outer face of the head, the chamber being accessible from outside the head through the opening to enable a leading part of the first end of the band that has passed through the passageway to be engaged in the chamber and used for pulling the first end through the passageway, and wherein the leading part of the first end is accommodated within said chamber, The second end of the band may be affixed to the head either (a) by being integrally formed with the head or (b) held in a second passageway within the head by teeth provided in the second passageway.

BRIEF DESCRIPTION OF DRAWINGS

There will now be described, by way of example only, an embodiment of the present invention, by reference to the accompanying drawings in which:

FIG. 6 is a perspective view of the fastener in accordance with the present invention; and.

BEST MODE FOR PUTTING THE INVENTION INTO EFFECT

Figure 6:
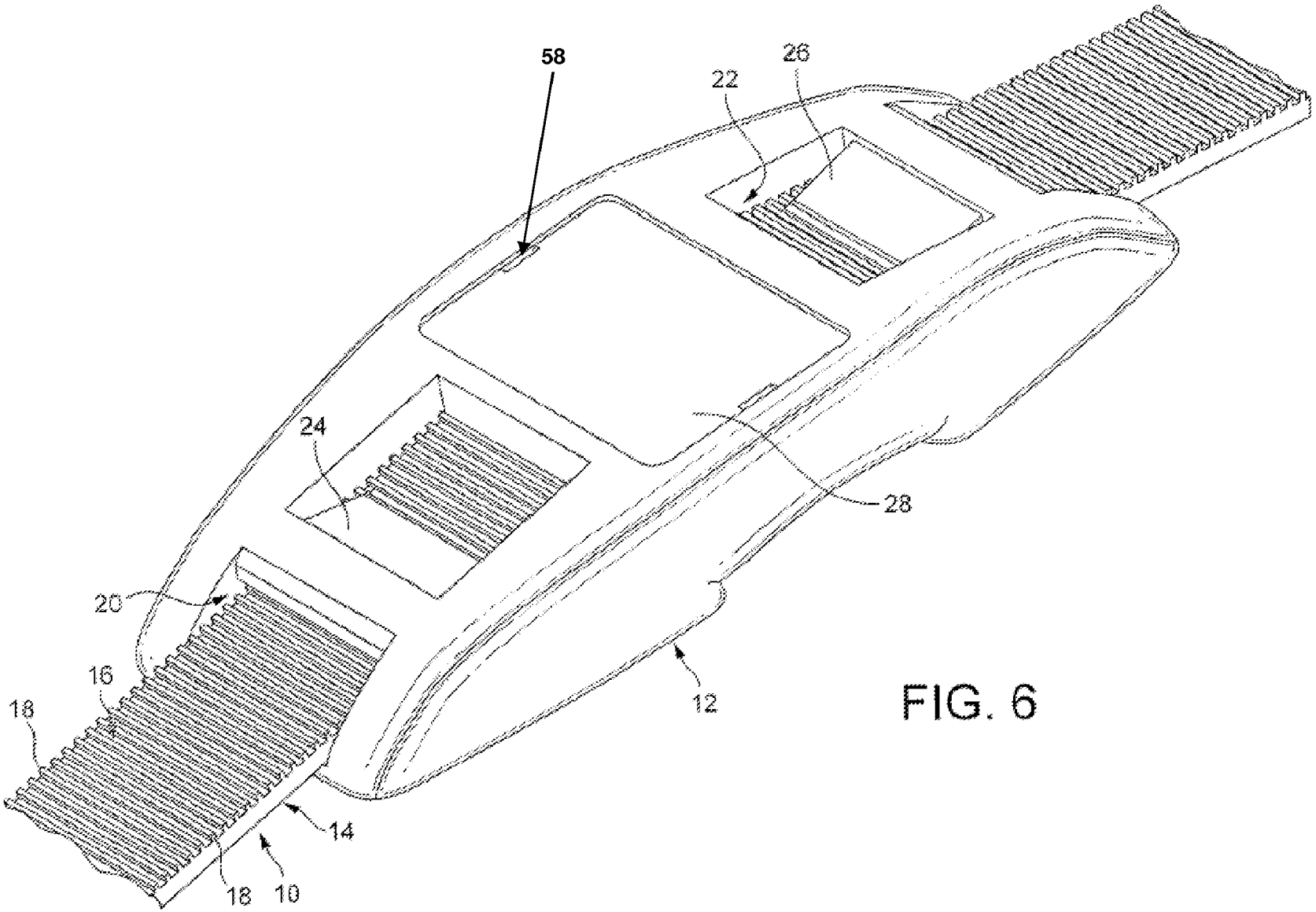

Referring initially to FIG. 6, there is shown a fastener made up of a band 10 and a head 12. Although it is not immediately evident from FIG. 6, the band 10 is formed in a closed loop for encircling an article to be clamped or secured. The band 10 includes two opposed surfaces—an inwardly facing surface 14 and an outwardly facing surface 16. The outwardly facing surface 16 includes a series of teeth 18 while the inwardly facing surface 14 is smooth so as not to bite into the article being clamped. The two ends of the band 10 are held by head 12 in a closed loop.

The head 12 has a pair of opposed passageways 20, 22 into which the ends of the strap are passed. A jaw 24, 26 is provided in each of the two passageways 20, 22; the jaws 24, 26 include teeth that are shaped to allow the strap to be pushed into the passageway, i.e. towards the centre of the head 12, but prevented the strap from being withdrawn in the opposite direction. This will be described in greater detail with reference to FIGS. 1 to 4. The head also includes a central chamber (not visible) provided under a removable cover 28. Again, this will be described in further detail below.

Figure 1:
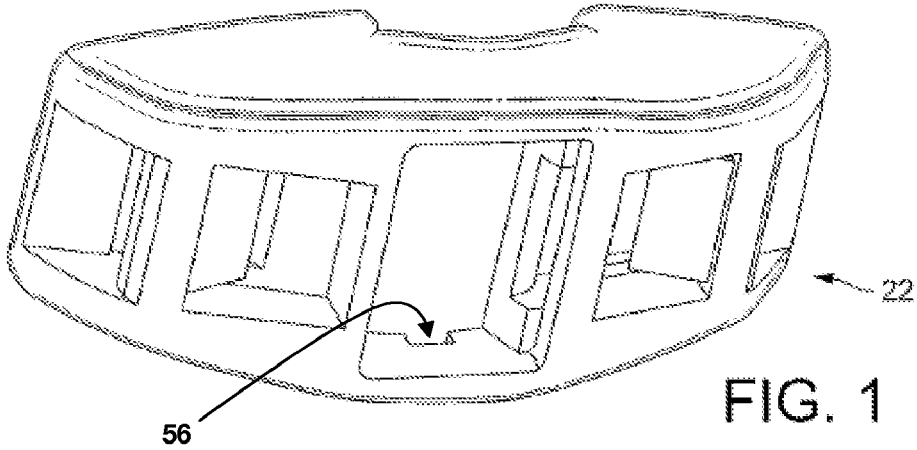
FIG. 1 is a perspective view of the head of a fastener in accordance with the present invention.
Figure 2:
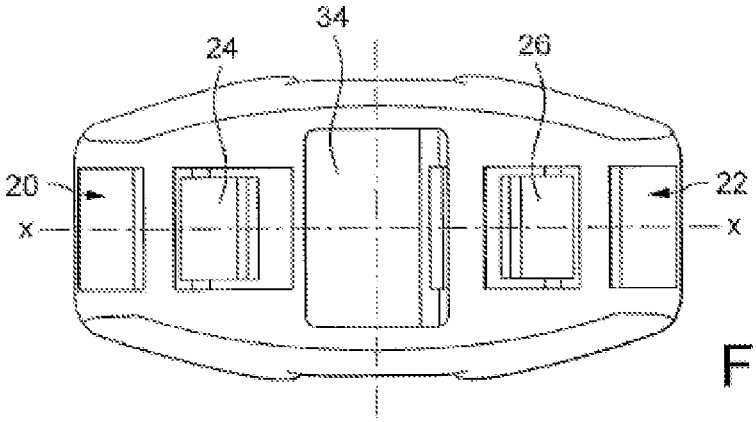
FIG. 2 is a plan view of the head of FIG. 1.
Figure 3:
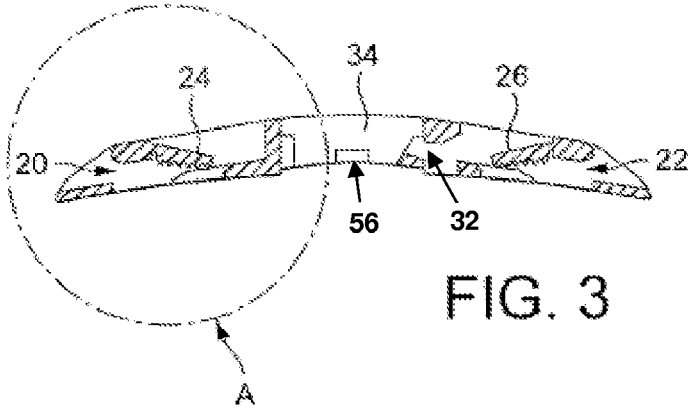
FIG. 3 is a cross-sectional view taken along the line X-X shown in FIG. 2.
Figure 4:
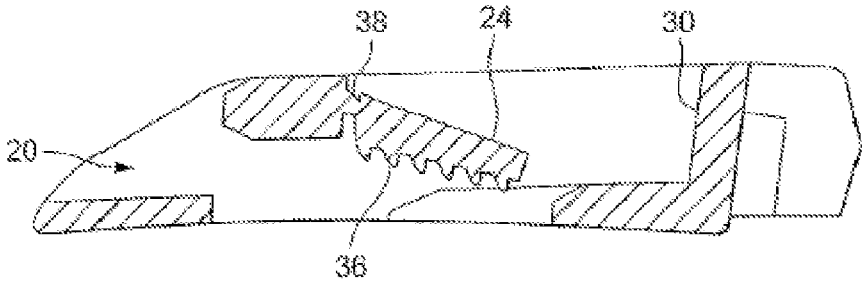
FIG. 4 is a detailed view of the cross-section shown in FIG. 3.

Referring now to FIGS. 1 to 4, the head is shown in perspective (FIG. 1) in plan view (FIG. 2), in sectional view along the line X-X (FIG. 2) and a detail of region A of FIG. 3 (FIG. 4). The passageways 20, 22 for feeding the ends of the band are shown. The end of passageway 20 is defined by a solid wall 30 whereas the end of the passageway 22 includes a channel 32 that leads into a chamber 34. Thus, the end of the band 10 in channel 20 rests against the end wall 30 whereas the end of the band 10 in passageway 22 extends through to chamber 34.

Part of the way along the passageway 20, 22, jaws 24, 26 are provided. As is best seen from FIG. 4, the lower surface of each jaw 24, 26 has teeth 36. The leading face of each tooth 36 is chamfered and when the band 10 is pushed into the channels 20, 22, the engagement of the leading faces of the teeth 36 with the leading face of the band 10 causes the jaw 24, 26 to be displaced upwardly about a flexing point 38. However, the back surfaces of the teeth 36 engage the teeth 16 on the band 10 and prevent the band being pulled out of the respective channels 20, 22. The resilience of the flexing region 38 keeps the jaw 24, 26 always in engagement with the band 10. The arrangement shown in the drawings is such that, when a band is inserted fully into the passageways 20, 22, all the teeth 36 on the jaws 24, 26 engage teeth on the band 10. The ends of the band 10 can be released, if desired, from the passageways 20, 22 by lifting the appropriate jaw upwardly free of the teeth of the band, thereby allowing the band to be slid out of passageways 20, 22.

Figure 5:
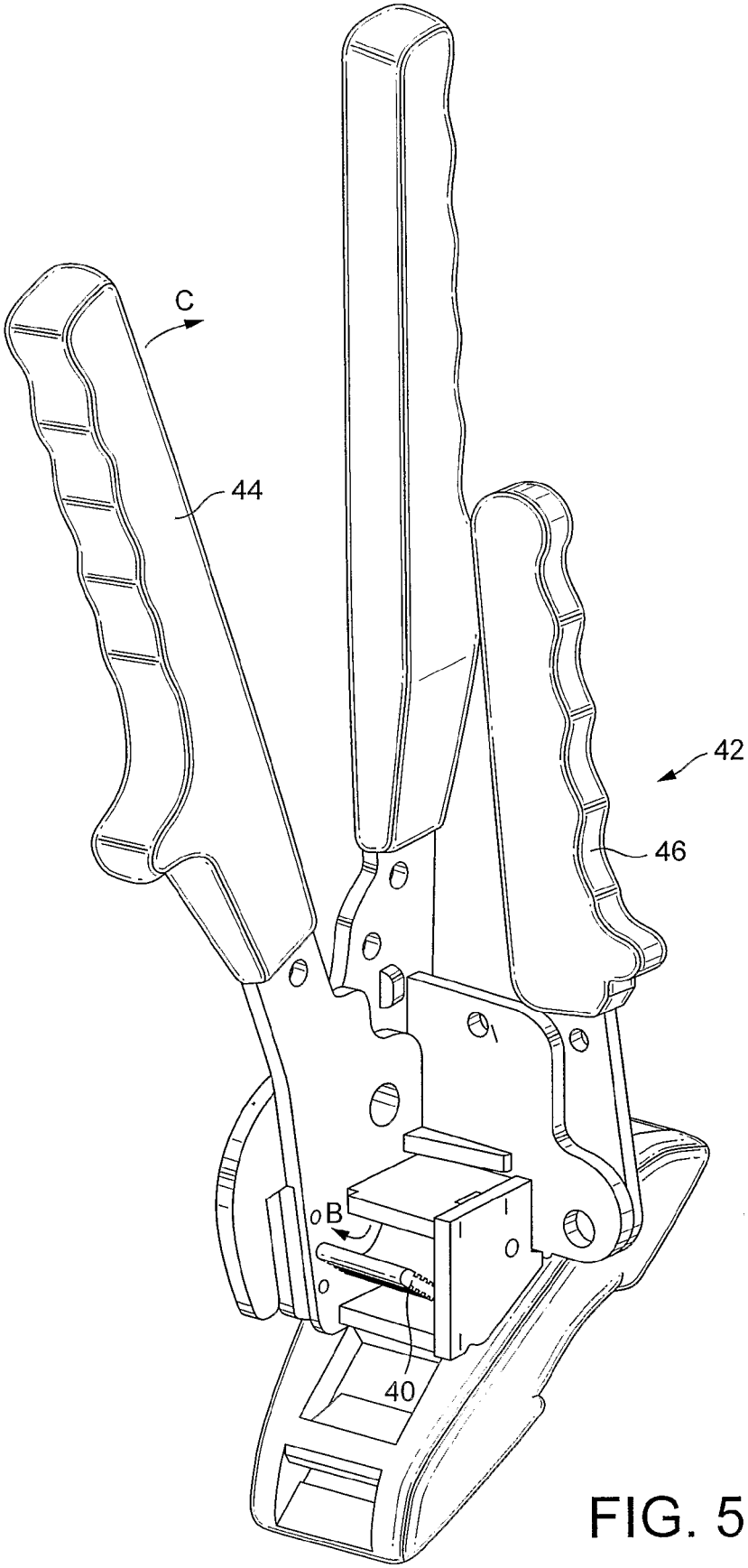
FIG. 5 is a perspective view showing a tool for fastening the band of the fastener within the head shown in FIG. 4.
Figure 7:
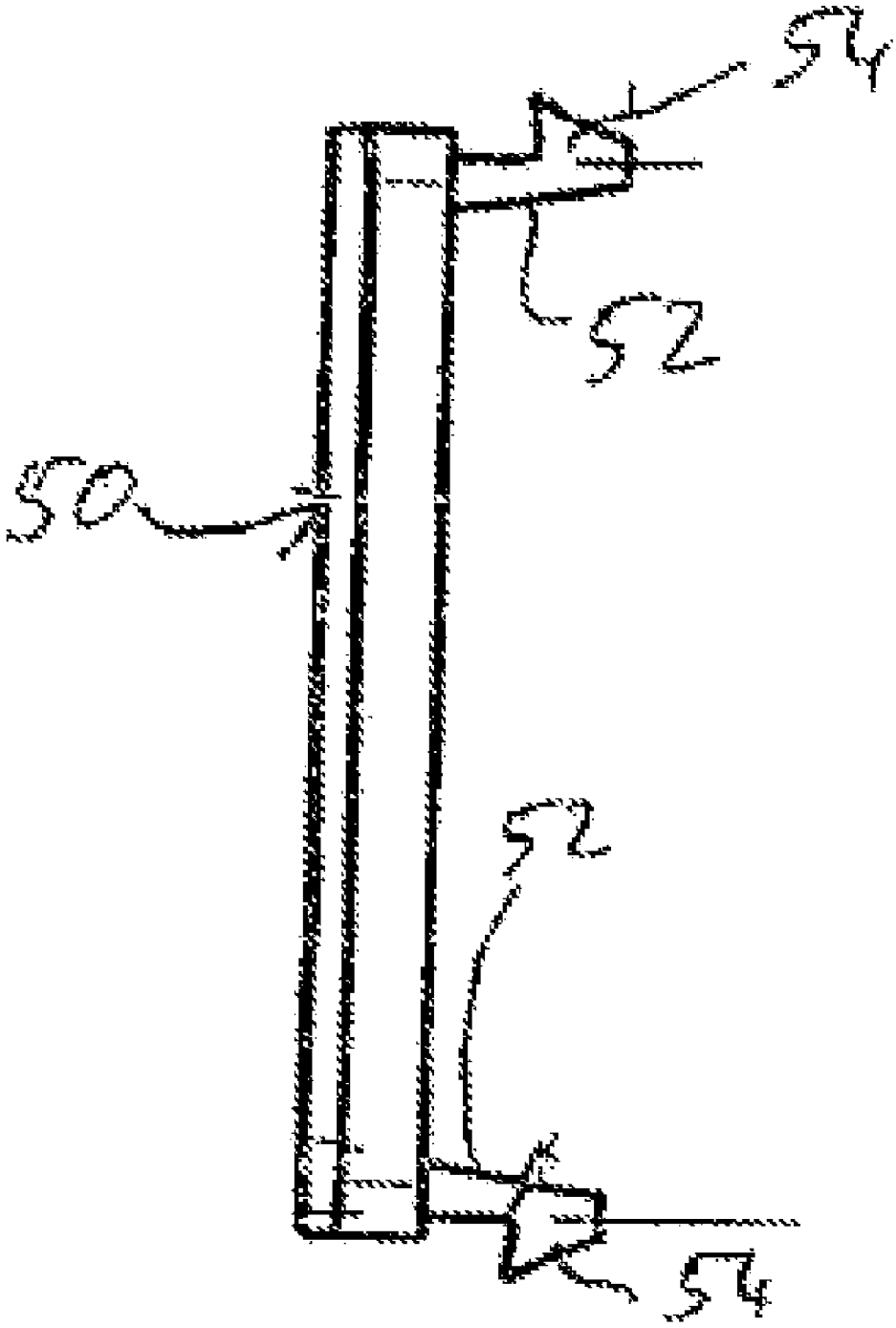
FIG. 7 is a side view of a cover for the fastener of FIGS. 1 to 4 and 6.

In order to tighten the fastening shown in FIGS. 1 to 4 and 6 about an object, an end 15 of the band is slid through passageway 20 until it reaches the end wall 30, thereby engaging the jaw 24 with the teeth on the top surface of the band. The band is then looped around the object and the other end 17 is passed into passageway 22. The leading part of the band passes through channel 32 into chamber 34 where it can be gripped to tighten the band. A special tool (see FIG. 5) can be used to tighten the band 10. The tool, which is shown in a manual version although it could be powered, includes a toothed member 40 that engages with the teeth on the end of the band. The toothed member 40 can be moved in the direction of arrow B by moving the handle 44 in the direction of arrow C, which causes the band to be pulled through passageway 22 and tightened. The band is secured in passageway 22 by the jaw 26, whose teeth engage the teeth on the top of the band. The tool 42 also includes a cutter 46 that can cut the band 10 within the chamber 34 when the desired tension in the band has been achieved. The location of the cut end of the band 10 in chamber 34 keeps it out of the way and prevents it from snagging. In addition, the chamber 34 can be closed with a cover 50 (see FIG. 7) that has two legs 52, each having a latch 54 at its end. The cover 50 can be placed over the top of the chamber 34 so that the legs extend into the chamber and engage in recesses 56, thereby locking the cover 50 and closing the chamber 34. This further isolates the cut end of the band. The cover 50 can be removed by inserting a screwdriver into a slot 58 (see FIG. 6). The cover is preferably flexible so that it flexes when the rest of the head flexes, which prevents one of the edges of the cover standing proud of the surrounding surface of the head when the head is flexed.

As can be seen, the fastener has a low profile and the comers of the head are rounded, i.e. it has no sharp edges, thereby reducing the chances of it snagging. The maximum height of the head is preferably less than 70%, more preferably less than 60%, e.g. less than 50%, of the width of the channel 22.

The band and head can be made of any of a variety of different materials, e.g. nylon 6.6 or nylon 11, which are suitable for offshore application.

The invention claimed is:

1. A method of securing a fastener around at least one object, the fastener comprising:

a band having a first and a second end and teeth provided on at least the first end; and a head for holding the band in a closed loop, the head having an inner face configured to be directed towards the inside of the loop when formed and an outer face opposed to the inner face; wherein the method comprises:

engaging the second end of the band with the head, if it is not already so engaged;

forming the band into a loop;

passing the first end of the band into a passageway that is formed in the head and that includes at least one tooth and engaging the said at least one tooth with the teeth on the first end of the band, passing the first end of the band into a chamber in the head located at one end of the passageway, wherein the chamber has an opening that is formed in the outer face of the head, and engaging, through the opening in the outer face of the head, a leading part of the first end of the band and pulling the first end of the band through the passageway to tighten the band on the at least one object, wherein the leading part of the first end of the band is accommodated in the chamber when the band has been tightened and the head is so configured that the first and second ends of the band, when secured to the head, are such that they are positioned side-by-side with each other and within the head.

2. A method as claimed in claim 1, wherein the passageway either terminates in the chamber or a second passageway is provided that is a continuation of the passageway, which second passageway is configured to receive the second end of the band and includes at least one tooth that is arranged to engage the teeth on the second end of the band and prevent it from being pulled out of the second passageway.

3. A fastener comprising:

a band having a first and a second end and teeth provided on at least the first end and a head for holding the band in a closed loop, the head having an inner face configured to be directed towards the inside of the loop when formed and an outer face opposed to the inner face, wherein the head comprises:

a passageway for receiving the first end of the band, the passageway including at least one tooth that is arranged to engage the teeth on the first end of the band and prevent the band from being pulled out of the passageway; and a chamber located at one end of the passageway and having an opening in the outer face of the head, the chamber being accessible, through the opening, from outside the head to enable a leading part of the first end of the band that has passed through the passageway to be engaged and used to pull the first end of the band through the passageway, and wherein said chamber is configured to accommodate the leading part of the first end, wherein the passageway terminates in the chamber and the head is so configured that the first and second ends of the band, when secured to the head, are such that they are positioned side-by-side with each other and within the head.

4. A fastener as claimed in claim 3, wherein the chamber includes an openable and closeable cover for the opening that is configured to close the opening of the chamber, thereby preventing access to the chamber from outside the head, and that is also configured to allow the opening to be opened, thereby allowing access to the chamber from outside the head.

5. A fastener as claimed in claim 3, which includes a second passageway for receiving the second end of the band, the passageway including at least one tooth that is arranged to engage teeth on the second end of the band and prevent the second end from being pulled out of the second passageway.

6. A fastener as claimed in claim 5, wherein the passageway, the chamber and the second passageway are arranged side-by-side in the head.

7. A fastener as claimed in claim 3, wherein the second end of the band is permanently secured to the head.

8. A fastener as claimed in claim 7, wherein the second end of the band is secured to the head at an anchor point and wherein the passageway, the chamber and anchor point are arranged side-by-side in the head.

9. A fastener as claimed in claim 3, wherein the band has a pair of opposed faces and said teeth are provided only on one face of the band.

10. A fastener as claimed in claim 9, wherein the face of the band on which the teeth are provided is the face that is directed outwardly when the band is formed into a closed loop.

11. A fastener as claimed in claim 3, wherein the corners of the head are rounded.

12. A fastener as claimed in claim 3, wherein the maximum height of the head is less than 50% of the width of the passageway.

13. A fastener comprising:

a band formed into a closed loop, said band having a first end and a second end and teeth on at least the first end and a head holding the band in a closed loop, the head having an inner face directed towards the inside of the loop and an outer face opposed to the inner face, wherein the second end of the band is affixed to the head and wherein the head comprises:

a passageway in which the first end of the band is received, the passageway including at least one tooth that engages the teeth on the first end of the band and prevents the band from being pulled out of the passageway; and a chamber located at one end of the passageway and having an opening in the outer face of the head, the chamber being accessible from outside the head through the opening to enable a leading part of the first end of the band that has passed through the passageway to be engaged in the chamber, the leading part of the first end being accommodated within the chamber;

wherein the head is so configured that the first and second ends of the band, when secured to the head, are such that they are positioned side-by-side with each other and within the head.

14. A fastener as claimed in claim 13, wherein the second end of the band is affixed to the head either (a) by being integral formed with the head or (b) by being held within a second passageway within the head.

15. A fastener comprising:

a band having a first and a second end and teeth provided on at least the first end and a head for holding the band in a closed loop, the head having an inner face configured to be directed towards the inside of the loop when formed and an outer face opposed to the inner face, wherein the head comprises:

a passageway for receiving the first end of the band, the passageway including at least one tooth that is arranged to engage the teeth on the first end of the band and prevent the band from being pulled out of the passageway;

a chamber located at one end of the passageway and having an opening in the outer face of the head, the chamber being accessible, through the opening, from outside the head to enable a leading part of the first end of the band that has passed through the passageway to be engaged and used to pull the first end of the band through the passageway, and wherein said chamber is configured to accommodate the leading part of the first end; and a second passageway is provided that is a continuation of the passageway and is configured to receive the second end of the band, the second passageway including at least one tooth that is arranged to engage the teeth on the second end of the band and prevent the band from being pulled out of the second passageway;

wherein the head is so configured that the first and second ends of the band, when secured to the head, are such that they are positioned side-by-side with each other and within the head.

16. A fastener comprising:

a band having a first and a second end and teeth provided on at least the first end and a head for holding the band in a closed loop, the head having an inner face configured to be directed towards the inside of the loop when formed and an outer face opposed to the inner face, wherein the head comprises:

a passageway for receiving the first end of the band, the passageway including at least one tooth that is arranged to engage the teeth on the first end of the band and prevent the band from being pulled out of the passageway;

a chamber located at one end of the passageway and having an opening in the outer face of the head, the chamber being accessible, through the opening, from outside the head to enable a leading part of the first end of the band that has passed through the passageway to be engaged and used to pull the first end of the band through the passageway, and wherein said chamber is configured to accommodate the leading part of the first end; and an openable and closeable cover for the opening of the chamber, the cover configured to close the opening of the chamber, thereby preventing access to the chamber from outside head, and also configured to allow the opening to be opened, thereby allowing access to the chamber from outside the head;

wherein the passageway terminates in the chamber.

* * * * *

UNITED STATES PATENT AND TRADEMARK OFFICE

CERTIFICATE OF CORRECTION

PATENT NO. : 7,882,598 B2
APPLICATION NO. : 11/576980
DATED : February 8, 2011
INVENTOR(S) : David Coles It is certified that error appears in the above-identified patent and that said Letters Patent is hereby corrected as shown below:

Column 7, Line 39, Claim 14:

After "(a) by being" delete "integral"
and insert -- integrally --.

Signed and Sealed this
Sixteenth Day of August, 2011

David J. Kappos

David J. Kappos
*Director of the United States Patent and Trademark Office*